US005419976A

United States Patent [19]

Dulin

[11] Patent Number: 5,419,976

[45] Date of Patent: May 30, 1995

[54] THERMAL SPRAY POWDER OF TUNGSTEN CARBIDE AND CHROMIUM CARBIDE

[76] Inventor: Bruce E. Dulin, 54 Hickory Rd., Manor Haven, N.Y. 11050

[21] Appl. No.: 163,806

[22] Filed: Dec. 8, 1993

[51] Int. Cl.[6] ..... C22C 29/08

[52] U.S. Cl. ..... 428/570; 428/937; 75/252

[58] Field of Search ..... 428/570, 937; 75/252; 427/451

[56] References Cited

U.S. PATENT DOCUMENTS

| | | | |
|---|---|---|---|
| 2,731,711 | 1/1956 | Lucas | 75/252 |
| 3,071,489 | 1/1963 | Pelton et al. | 117/22 |
| 3,150,938 | 9/1964 | Pelton et al. | 29/194 |
| 3,305,326 | 2/1967 | Longo | 75/252 |
| 3,617,358 | 11/1971 | Dittrich | 117/105.2 |
| 3,743,533 | 7/1973 | Yurask | 117/105.2 |
| 3,914,507 | 10/1975 | Fustukian | 428/404 |
| 3,936,295 | 2/1976 | Cromwell et al. | 427/451 |
| 3,974,245 | 8/1976 | Cheney et al. | 264/10 |
| 4,064,608 | 12/1977 | Jaeger | 29/132 |
| 4,416,421 | 11/1983 | Browning | 239/79 |
| 4,507,151 | 3/1985 | Simm et al. | 428/570 |
| 4,588,608 | 5/1986 | Jackson et al. | 427/34 |
| 4,606,948 | 8/1986 | Kajmrle et al. | 427/423 |
| 4,731,253 | 3/1988 | Dubois | 427/451 |
| 4,822,415 | 4/1989 | Dorfman et al. | 75/251 |
| 4,865,252 | 9/1989 | Rotolico et al. | 239/8 |
| 4,923,511 | 5/1990 | Krizan et al. | 75/252 |
| 4,925,626 | 5/1990 | Anand et al. | 419/18 |
| 4,999,225 | 3/1991 | Rotolico et al. | 427/423 |
| 5,006,321 | 4/1991 | Dorfman et al. | 427/192 |
| 5,075,129 | 12/1991 | Jackson et al. | 427/451 |
| 5,098,748 | 3/1992 | Shimizu et al. | 427/451 |

FOREIGN PATENT DOCUMENTS

| | | | |
|---|---|---|---|
| 1811196 | 6/1970 | Germany | 75/252 |
| 867455 | 1/1959 | United Kingdom | 23 C/22 C |
| 884836 | 12/1961 | United Kingdom | 427/451 |
| 83/1917 | 6/1983 | WIPO | 425/570 |

*Primary Examiner*—John Zimmerman
*Attorney, Agent, or Firm*—H. S. Ingham

[57] ABSTRACT

A thermal spray powder is formed as a mixture of tungsten carbide granules and chromium carbide granules. The tungsten carbide granules each consists essentially of tungsten carbide bonded with cobalt, and the chromium carbide granules each consists essentially of chromium carbide bonded with nickel-chromium alloy. The powder may be asmixed with self-fluxing alloy powder. The powder preferably is sprayed with a high velocity oxygen-fuel thermal spray gun.

11 Claims, No Drawings

THERMAL SPRAY POWDER OF TUNGSTEN CARBIDE AND CHROMIUM CARBIDE

This invention relates to thermal spraying and particularly to a powder of tungsten carbide and chromium carbide for thermal spraying.

BACKGROUND OF THE INVENTION

Thermal spraying, also known as flame spraying, involves the melting or at least heat softening of a heat fusible material such as metal or ceramic, and propelling the softened material in particulate form against a surface which is to be coated. The heated particles strike the surface where they are quenched and bonded thereto. A thermal spray gun is used for the purpose of heating and propelling the particles. In one type of thermal spray gun, the heat fusible material is supplied to the gun in powder form. Such powders typically comprise small particles, e.g., between 100 mesh U.S. Standard screen size (149 microns) and about 2 microns. Heat for powder spraying generally is provided by a combustion flame or an arc-generated plasma flame. The carrier gas, which entrains and transports the powder, may be one of the combustion gases or an inert gas such as nitrogen, or it may be compressed air.

Improved coatings may be produced by spraying at high velocity. For example, plasma spraying has proven successful for high velocity in many respects but it can suffer from non-uniform heating and/or poor particle entrainment which must be effected by feeding powder laterally into the high velocity plasma stream.

High velocity oxygen-fuel (HVOF) types of powder spray guns recently became practical and are typified in U.S. Pat. Nos. 4,416,421 and 4,865,252. This type of gun has a combustion chamber with a high pressure combustion effluent directed through a nozzle or open channel. Powder is fed into the nozzle chamber to be heated and propelled by the combustion effluent. Methods of spraying various materials with high velocity oxygen-fuel guns are taught in U.S. Pat. Nos. 4,999,225 and 5,006,321.

Another type of thermal spraying is effected with a detonation gun in which pulses of fuel mixture and powder are injected into a chamber with a long barrel and detonated. Successive high velocity bursts of the heated powder are directed to a substrate. This system is complex, costly and requires an enclosure against the noise bursts.

Wear resistance is a common requirement for thermal sprayed coatings, and carbide powders are frequently used, for example tungsten carbide. British patent specification No. 867,455 typifies cobalt bonded tungsten carbide powder admixed with a sprayweld self-fluxing powder for producing coatings. Often such coatings are subsequently fused. Self-fluxing alloys are nickel, cobalt or iron based alloys with chromium and with small amounts of boron, silicon and carbon which serve as fluxing agents and hardeners. Examples of self-fluxing alloys are disclosed in the aforementioned British patent specification and U.S. Pat. Nos. 3,743,533 and 4,064,608. Iron base alloys with molybdenum, boron and silicon are disclosed in U.S. Pat. No. 4,822,415.

The cobalt-tungsten carbide itself is also sprayed neat, i.e. without the self-fluxing ingredient, best results being with high velocity, particularly plasma spray or a high velocity oxygen-fuel (HVOF) gun or a detonation gun. The granules of a powder typically are formed of subparticles of tungsten carbide and cobalt, spray dried, sintered or fused, the result being crushed and classified into a powder of proper size for thermal spraying.

Another carbide is chromium carbide that is utilized for higher temperature applications. This carbide may be sprayed without any metal binder, but it usually is clad or bonded with nickel or nickel alloy, such as nickel-chromium alloy, such as described in U.S. Pat. Nos. 3,150,938 and 4,606,948.

Tungsten carbide and chromium carbide have been combined together with nickel for the detonation process as taught in U.S. Pat. Nos. 3,071,489. In one aspect of this patent, the elemental ingredients are all mixed together, and then sintered and crushed into a powder. In another aspect, separate powders of tungsten carbide, chromium carbide and nickel are blended to form a powder mixture of the three ingredients. In this form there is a tendency for the carbide to lose carbon in the flame. The two carbides also have been combined together with cobalt (without nickel) in a powder formed by casting and crushing, or by sintering, as taught in U.S. Pat. No. 4,925,626. Cobalt does not have as high corrosion resistance as nickel.

The latter patent teaches a method for producing a coating material of WC-Co-Cr alloy for high velocity oxygen-fuel thermal spraying. A mixture is prepared of tungsten carbide, cobalt and chromium, the latter being in the form of chromium carbide. The mixture is alloyed by by spray drying followed by sintering and plasma densification.

U.S. Pat. No. 4,588,608 teaches a powder for the detonation process, in which the powder is a cast and crushed composition of tungsten carbides, chrominum and cobalt. Two proprietary coatings of this nature are LW-45 and LW-15 produced by Praxair, Inc., Danbury, Conn., by the detonation process. LW-45 nominally contains 8% cobalt 4% chromium and balance tungsten carbide. LW-15 nominally contains 84% tungsten, 8% cobalt, 3% chromium and 5% carbon. These coatings have been utilized in specified applications such as petrochemical gate valves.

SUMMARY OF THE INVENTION

An object of the present invention is to provide an improved powder of tungsten carbide and chromium carbide for the thermal spray process. Another object is to provide improved corrosion resistance in wear resistant carbide coatings. Further objects are to provide improved impact and toughness in such coatings.

The foregoing and other objects are achieved by a thermal spray powder formed as a mixture of tungsten carbide granules and chromium carbide granules. The tungsten carbide granules each consist essentially of tungsten carbide bonded with cobalt, and the chromium carbide granules each consist essentially of chromium carbide bonded with nickel-chromium alloy. The powder may be admixed with a self-fluxing alloy powder, advantageously iron based.

Objects are also achieved by a method of producing a carbide coating utilizing a thermal spray gun having a combustion chamber with an open channel for propelling combustion products into the ambient atmosphere at supersonic velocity. The method comprises preparing a substrate for receiving a thermal sprayed coating, feeding through the open channel a carbide powder, injecting into the chamber and combusting therein a combustible mixture of combustion gas and oxygen at a pressure in the chamber sufficient to produce a supersonic spray stream containing the powder issuing through the open channel, and directing the spray stream toward the substrate so as to produce a coating thereon. The carbide powder is formed as a mixture as set forth above.

DETAILED DESCRIPTION OF THE INVENTION

According to the invention a thermal spray powder is formed as a mixture of tungsten carbide granules and chromium carbide granules. The tungsten carbide granules each consist essentially of tungsten carbide bonded with cobalt, and the chromium carbide granules each consist essentially of chromium carbide bonded with nickel-chromium alloy.

The tungsten carbide granules should contain between 10 and 20 weight percent cobalt based on the the total of tungsten carbide and cobalt. The chromium carbide granules should contain between 15 and 30 weight percent of the alloy based on the total of chromium carbide and alloy. The powder mixture should consist essentially of between 40 and 80 weight percent of the tungsten carbide granules, and remainder the chromium carbide granules.

Preferably, the granules of tungsten carbide granules each consists essentially of sintered subparticles of tungsten carbide and cobalt. Also, preferably the granules of chromium carbide granules each consists essentially of sintered subparticles of chromium carbide and nickel-chromium alloy. The nickel-chromium alloy should consist essentially of between 10 and 30 percent chromium by weight of the alloy, and balance nickel.

Each of the carbide powders may be formed by conventional methods such as spray drying as described in U.S. Pat. No. 3,617,358, or spray drying and subsequent heating as described in U.S. Pat. No. 3,974,245. Preferably the powders are formed by blending the carbide and metal constituents, sintering the blend in vacuum or inert atmosphere, crushing and screening to provide the desired powder size. In order to minimize solutioning of the carbides into the metal matrix, most preferably the sintering is a light sintering, generally between 1000° C. and 1100° C. Sintering time at such temperature should be between 90 minutes for the lower temperature and 30 minutes for the higher temperature, for example 60 minutes at 1035° C. Final powder size should be between 3 and 80 microns, preferably between 10 and 44 microns for HVOF spraying.

In one aspect of the invention, the mixture of metal bonded tungsten and chromium carbides is utilized as-is for spraying with a thermal spray gun.

In another aspect, the carbide mixture is further admixed with a self-fluxing alloy powder. The self-fluxing alloy should be nickel, cobalt and/or iron with up to 20% chromium and small amounts of boron, silicon and carbon. The boron contentshould be between 2% and 4%, the silicon between 2% and 4%, and the carbon between 0.1% and 0.6% of the alloy (all percentages herein are by weight.). The alloy may be generally of a type disclosed in the aforementioned British patent specification No. 867,455 and U.S. Pat. No. 3,743,533. The self-fluxing alloy should be present in an amount between 30% and 70% by weight of the total of the carbide (including its metal binder) and alloy in the admixture. The alloy powder size should be about the same size as the carbides. The admixture is sprayed with a conventional or other desired thermal spray gun. The resulting coating may be fused by heating with a flame torch or a furnace, for example to 950° C. for sufficient time for the coating to coalesce. However, if sprayed with a plasma gun or a high velocity oxygen-fuel gun, such fusing may not be necessary. An iron base self-fluxing alloy requires at least 20% nichel content for successful fusing.

The bonded carbide mixture, or its admixture with self-fluxing alloy is preferably sprayed with a high velocity oxygen-fuel gun, for example of the type disclosed in the aforementioned U.S. Pat. No. 4,865,252 which is incorporated herein by reference. Such a gun includes a nozzle member with a nozzle face and a tubular gas cap extending from the nozzle member. The gas cap has an inwardly facing cylindrical wall defining a combustion chamber with an open end and an opposite end bounded by the nozzle face. Prior to spraying, a metallic substrate is prepared for receiving a thermal sprayed coating by light grit blasting or the like.

In a preferable embodiment., the gun is operated by injection of an annular flow of a combustible mixture of a combustion gas (e.g. hydrogen or propylene) and oxygen from the nozzle coaxially into the combustion chamber at a pressure therein of at least two bar above atmospheric pressure. An annular outer flow of pressurized non-combustible gas is injected adjacent to the cylindrical wall radially outward of the annular flow of the combustible mixture. A powder comprising carbide particles is fed in a carrier gas axially from the nozzle into the combustion chamber. An annular inner flow of pressurized gas is injected from the nozzle member into the combustion chamber coaxially between the combustible mixture and the powder-carrier gas. The combustible mixture is combusted in the combustion chamber so that a supersonic spray stream containing the heat fusible material in finely divided form is propelled through the open end. The spray stream is directed toward the prepared substrate so as to produce a coating thereon.

Coatings in accordance with the invention are useful, for example, for high pressure gate valves and gate seats in petrochemical lines, pump seals, butterfuly valves, incinerator ducting, fan blades, thread guides, wire drawing capstans and mandrels.

EXAMPLE 1

A tungsten carbide powder of size 10 to 44 microns was ball milled together with 99+% purity cobalt powder less than 1.5 microns. The cobalt was 12% of the total of carbide and cobalt. (All percentages herein are by weight.) The resulting blend was compacted into blanks which were sintered in vacuum for 30 minutes at 1300° C. The lightly sintered product was then crushed by conventional roll crushers in a series of 2 to 3 rollers, screening out the coarse particles, and air classifying to −44 +15 microns. The result was a powder formed of granules cobalt bonded tungsten carbide powder.

A chromium carbide powder of size 10 to 44 microns was ball milled together with 99+% purity nickel-chromium alloy powder less than 1.5 microns. The alloy contained 20% chromium based on the total of nickel and chromium in the alloy. The alloy consisted of 35% of the total of carbide and alloy. The resulting blend was compacted into blanks which were sintered in vacuum for 30 minutes at 1300° C. The sintered product was then crushed by conventional roll crushers in a series of 2 to 3 rollers, screening out the coarse particles, and air classifying to −44 +15 microns. The result was a powder ofgranules of a nickel-chromium alloy bonded chromium carbide powder. The two carbide powders were thoroughly mixed in a proportion of 65% cobalt bonded tungsten carbide and balance alloy bonded chromium carbide.

The foregoing mixture was thermal sprayed with a high velocity oxygen-fuel gun of the type disclosed in the aforementioned U.S. Pat. No. 4,865,252 and sold as a Metco(TM) Type DJ Hybrid 2600 Gun by The Perkin-Elmer Corporation. A #8 siphon plug, #8 insert, #8 injector #8 shell and #2603 aircap were used. Oxygen was 10.5 kg/cm$^2$ (150 psig) and 212 l/min (450 scfh); hydrogen gas was 7.0 kg/cm$^2$ (100 psig) and 47 l/min (100 scfh); and air was 5.3 kg/cm$^2$ (75 psig) and 290 l/min (615 scfh). A high presure powder feeder of the type disclosed in U.S. Pat. No. 4,900,199 an sold as a Metco Type DJP(TM) by Perkin-Elmer was used to feed the powder blend at 60 gm/min (4 lbs/hr) in a nitrogen carrier at 8.8 kg/cm$^2$ (125 psig) and 7 l/min (15 scfh). Spray distance was 20 cm. The as-sprayed coating was ground conventionally with diamond wheels, using 550 surface feet per minuite (1675 m/min); rough grinding with a 240 grit wheel, size with a 400 grit wheel and finish with a 600 grit wheel.

EXAMPLE 2

A mixture was prepared with the same carbide constuents as in Example 1, except that the proportion of the cobalt bonded tungsten carbide was 80% of the total with the alloy bonded chromium carbide. This mixture was thermal sprayed with HVOF in the same manner.

EXAMPLE 3

A chromium carbide powder was formed by cladding an alloy of nickel and 20% chromium onto core particles of chromium carbide. The alloy was 20% of the total of alloy and chromium carbide. The powder was sized between 11 and 45 microns. The clad powder was obtained from Sherritt-Gordon Mines Ltd, Saskatchewan, Canada, and was similar to powder disclosed in the aforementioned U.S. Pat. No. 3,914,507. This clad chromium carbide powder was mixed with 65% of the cobalt bonded tungsten carbide powder of Example 1. This mixture was thermal sprayed with HVOF in the same manner.

EXAMPLE 4

A mixture was prepared with the same carbide constuents as in Example 3, except that the proportion of the cobalt bonded tungsten carbide was 80% of the total with the alloy clad chromium carbide. This mixture was thermal sprayed with HVOF in the same manner.

EXAMPLE 5

The mixture of Example 1 was sprayed with a Metco Type 3MB-II plasma spray gun, and a Metco Type 3MP powder feeder, sold by Perkin-Elmer, using a 532 nozzle, argon plasma gas at 7.0 kg/cm$^2$ gage pressure (100 psig) and 46.7 standard l/min flow (100 scfh), hydrogen secondary gas at 7.0 kg/cm$^2$ (100 psig) and 4.7 l/min (10 scfh), power at 60 to 70 volts and 500 amperes, and 0.2 kg/min (5.5 lbs/hr) powder feed rate in argon carrier gas at 12 l/min (37 scfh).

EXAMPLE 6

The mixture of Example 1 was further admixed with 40% of a nickel base self-fluxing alloy sold as Metco 15F by Perkin-Elmer. Such an alloy contains 17% chromium, 4% iron, 3.5% boron, 4.0% silicon, 1.0% carbon, balance nickel, by weight, and has a size generally between 15 and 53 microns. A substrate was prepared and thermal spraying was effected in the same manner as in Example 1.

EXAMPLE 7

The mixture of Example 1 was further admixed with 40% of an iron base self-fluxing alloy of the type described in the aforementioned U.S. Pat. No. 4,822,415. Such an alloy contains 19% chromium, 20% nickel, 2% boron, 2% silicon, 0.5% carbon, balance iron, and has a size generally between 5 and 37 microns. A substrate was prepared and thermal spraying was effected in the same manner as in Example 1. In its as-sprayed condition, the coating hardess was Rc 45–50.

EXAMPLE 8

The mixture of Example 3 is further admixed with 40% of the iron base alloy of example 7. A substrate is prepared and thermal spraying is effected in the same manner as in Example 1. In its as-sprayed condition, the coating hardess was Rc 45–50.

EXAMPLE 9

The coatings produced in Examples 6, 7 and 8 are fused with an oxygen-acetylene torch at about 950° C. for 5 minutes and slowly cooled. The coatings are substantially fully dense and have excellent properties of wear and corrosion resistance.

Coatings of the foregoing examples 1 through 8 were tested and compared, the results being set forth in the Table. Examples A and B in the table are respectfully LW-45 and LW-15 coatings produced by Praxair, Inc., Danbury, Conn., by the detonation process; these materials are described herein above.

TABLE

| Ex. No. | Hardness DPH-300 | Finish μ rms | Carbide % out of Solution | Other Comparisons |
|---|---|---|---|---|
| 1 | 1000–1200 | 3.75–5 | 35–55 | Higher abrasive resistance, similar corrosion resistance, compared to Example A. |
| 2 | 1150–1250 | 3.75–5 | 35–55 | Higher abrasive resistance, lower corrosion resistance, than Examples 1 and B. |
| 3 | 1000–1200 | 3.75–5 | — | Slightly higher wear abrasive resistance than Example 1. |
| 4 | 1000–1200 | 3.75–5 | — | Higher abrasive wear resistance than Example 3. |
| 5 | 800–1000 | 7.5–12.5 | — | Higher abrasive resistance, lower thickness limit, than Example 1. |
| 6 | 800–1000 | 2.5–3.75 | — | Better corrosion resistance, better impact resistance, than Example 1. |
| 7 | 800–1000 | 2.5–3.75 | — | Better corrosion resistance, better impact resistance, than Example 1. |
| 8 | 900–1100 | 2.5–3.75 | — | Higher abrasive resistance than Example 1. |
| A | 900 | — | 10–25 | — |
| B | 1000 | — | 10–25 | — |

It may be seen that Examples 1 and 2, in particular, show improvements respectively over detonation gun coating Examples A and B.

While the invention has been described above in detail with reference to specific embodiments, various changes and modifications which fall within the spirit of the invention and scope of the appended claims will become apparent to those skilled in this art. The invention is therefore only intended to be limited by the appended claims or their equivalents.

We claim:

1. A thermal spray powder comprising a mixture of tungsten carbide granules and chromium carbide granules, the tungsten carbide granules each consisting essentially of tungsten carbide and cobalt, and the chromium carbide granules each consisting essentially of chromium carbide and nickel-chromium alloy, wherein the powder comprises between 50 and 80 weight percent of the tungsten carbide granules, and balance the chromium carbide granules, based on the total of the tungsten carbide granules and the chromium carbide granules.

2. The powder of claim 1 wherein the tungsten carbide granules contain between 10 and 20 weight percent cobalt based on the the total of tungsten carbide and cobalt, and the chromium carbide granules contain between 15 and 30 weight percent of the alloy based on the total of chromium carbide and alloy.

3. The powder of claim 1 wherein the tungsten carbide granules are each formed of sintered subparticles of tungsten carbide and cobalt.

4. The powder of claim 3 wherein the subparticles are lightly sintered.

5. The powder of claim 1 wherein the granules of chromium carbide granules are each formed of sintered subparticles of chromium carbide and cobalt.

6. The powder of claim 5 wherein the subparticles are lightly sintered.

7. The powder of claim 1 wherein the nickel-chromium alloy consists essentially of between 10 and 30 percent chromium by weight of the alloy, and balance nickel.

8. The powder of claim 1 wherein the tungsten carbide granules contain between 10 and 20 weight percent cobalt based on the the total of tungsten carbide and cobalt, the granules of tungsten carbide granules are each formed of sintered subparticles of tungsten carbide and cobalt, the chromium carbide granules contain between 15 and 30 weight percent of the alloy based on the total of chromium carbide and alloy, and the chromium carbide granules are each formed of sintered subparticles of chromium carbide and cobalt.

9. The powder of claim 1 further comprising a self-fluxing alloy powder in admixture.

10. The powder of claim 9 wherein the alloy powder is an iron base self-fluxing alloy powder containing at least 20% nickel.

11. The powder of claim 9 wherein the alloy powder is present in an amount between 30% and 70% of the total of the powder.

* * * * *